US008875677B2

(12) United States Patent
Uenoyama et al.

(10) Patent No.: US 8,875,677 B2
(45) Date of Patent: Nov. 4, 2014

(54) AIR CLEANER IN TWO-STROKE ENGINE

(75) Inventors: Kazuyuki Uenoyama, Tokyo (JP); Takahiro Kimura, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/695,498

(22) PCT Filed: Apr. 25, 2011

(86) PCT No.: PCT/JP2011/060077

§ 371 (c)(1),
(2), (4) Date: Oct. 31, 2012

(87) PCT Pub. No.: WO2011/138909

PCT Pub. Date: Nov. 10, 2011

(65) Prior Publication Data

US 2013/0047953 A1 Feb. 28, 2013

(30) Foreign Application Priority Data

May 7, 2010 (JP) ..... 2010-107200

(51) Int. Cl.

| | |
|---|---|
| ***F02B 25/00*** | (2006.01) |
| ***F02M 35/024*** | (2006.01) |
| ***F02M 17/34*** | (2006.01) |
| ***F02M 1/02*** | (2006.01) |
| *F02B 75/02* | (2006.01) |
| *F02B 25/22* | (2006.01) |

(52) U.S. Cl.

CPC ..... *F02M 1/02* (2013.01); *F02M 35/024* (2013.01); *F02B 2075/025* (2013.01); *F02B 25/22* (2013.01); *F02M 17/34* (2013.01)

USPC ..... 123/198 E; 123/65 R

(58) Field of Classification Search

CPC ..... F02M 35/04; F02M 35/02; F02M 35/08; F02M 35/10295; F02M 35/14; F02M 35/10229; F02M 35/10255

USPC ..... 123/198 E, 65, 65 R, 66–69 V; 55/482

See application file for complete search history.

(56) References Cited

U.S. PATENT DOCUMENTS 6,000,683 A * 12/1999 Van Allen ..... 261/52
6,827,338 B2 * 12/2004 Nonaka ..... 261/44.3

(Continued)

FOREIGN PATENT DOCUMENTS

JP 2000-170611 6/2000
JP 3073740 8/2000

(Continued)

OTHER PUBLICATIONS

Machine Translation of JP2001-055958A.*

(Continued)

*Primary Examiner* — Noah Kamen
*Assistant Examiner* — Long T Tran
(74) *Attorney, Agent, or Firm* — Wenderoth, Llind & Ponack, LLP

(57) ABSTRACT

An air cleaner in a two-stroke engine having an air supply passage and an air/fuel mixture supply passage includes: a first air passage and a second air passage arranged in parallel, the first air passage being communicated with the air supply passage and the second air passage being communicated with the air/fuel mixture supply passage; and a choke valve opening and closing both of the first air passage and the second air passage of the air cleaner. The choke valve has a pivot axis and a pivotable valve member pivoting about the pivot axis to open and close respective inlet openings of the first air passage and the second air passage. One of the first air passage and the second air passage that is located closer to the pivot axis has an inlet opening flattened along a pivoting edge of the valve member.

4 Claims, 2 Drawing Sheets

(56) References Cited

U.S. PATENT DOCUMENTS

| | | | | |
|---|---|---|---|---|
| 7,104,523 | B2 * | 9/2006 | Busato et al. | 251/214 |
| 7,104,526 | B2 * | 9/2006 | Mavinahally | 261/46 |
| 2001/0018898 | A1 | 9/2001 | Raffenberg et al. | |
| 2009/0283079 | A1 * | 11/2009 | Tsunoda | 123/65 PD |
| 2010/0192928 | A1 * | 8/2010 | Yuasa | 123/65 V |

FOREIGN PATENT DOCUMENTS

| | | |
|---|---|---|
| JP | 2001-55958 | 2/2001 |
| JP | 2001-263164 | 9/2001 |
| JP | 2003-35208 | 2/2003 |
| JP | 4052416 | 2/2008 |

OTHER PUBLICATIONS

Machine translation of JP 2001-055958A (see Yasua_JP2001-055958A_MachineTranslation.pdf).*

International Preliminary Report on Patentability and Written Opinion of the International Searching Authority issued Dec. 10, 2012 in corresponding International Application No. PCT/JP2011/060077 (with English translation).

International Search Report issued May 24, 2011 in corresponding International Application No. PCT/JP2011/060077.

Decision to Grant issued Nov. 18, 2013 in corresponding Japanese patent application No. 2010-107200.

Extended European Search Report issued Jun. 10, 2014 in corresponding European patent application No. 11 77 7428.

* cited by examiner

AIR CLEANER IN TWO-STROKE ENGINE

BACKGROUND OF THE INVENTION

1. Technical Field

The present invention relates to an air cleaner structure in two-stroke engines, and more particularly to an air cleaner structure in a two-stroke engine having an air passage that is connected midway of a scavenging passage communicating a scavenging port with a crank chamber and that supplies leading air from the air cleaner to the scavenging passage, and an air/fuel mixture passage supplying air/fuel mixture created in a carburetor to the crank chamber.

2. Description of the Related Art

A stratified scavenging two-stroke engine includes a scavenging passage communicating a scavenging port provided in a side portion of a cylinder with a crank chamber, an air passage connected midway of the scavenging passage for supplying scavenging air from an air cleaner to the scavenging passage, and an air/fuel mixture passage for supplying air/fuel mixture created in a carburetor to the crank chamber. Prior to supplying the air/fuel mixture from the scavenging port into the combustion chamber, leading air filtered in the air cleaner is introduced through the air passage, scavenging passage, and scavenging port into the combustion chamber for the scavenging effect, to reduce the amount of unburnt air/fuel mixture passing through.

In some stratified scavenging two-stroke engines configured as described above, there may be provided a choke valve for adjusting the amount of air supplied to each of the air passage and the air/fuel mixture passage when the engine is started. In this case, the respective inlets of the air passage and the air/fuel mixture passage may be provided with a separate choke valve, for example. However, providing separate choke valves for the respective inlets of the air passage and the air/fuel mixture passage will make the operating system of the choke valves complex because of the increased number of choke valves, and will increase the size of the entire device associated with the stratified scavenging two-stroke engine.

Japanese Patent No. 4052416, for example, discloses a technique for adjusting the amount of air each supplied to both of the air passage and the air/fuel mixture passage with one choke valve. The patent relates to a two-stroke engine including a scavenging passage communicating a scavenging port provided in a side portion of a cylinder with a crank chamber, an air supply passage connected midway of the scavenging passage for supplying scavenging air from an air cleaner to the scavenging passage, and an air/fuel mixture supply passage for supplying air/fuel mixture created in a carburetor to the crank chamber. The air cleaner includes a first air passage and a second air passage arranged in parallel, the first air passage communicated with the air supply passage and the second air passage connected to an air inlet of the carburetor for supplying air to the carburetor for the generation of the air/fuel mixture. The air cleaner includes a choke valve opening and closing the first air passage and the second air passage. The choke valve includes a rotary valve member opening and closing each of the inlet openings of the first air passage and the second air passage by rotation, and a rotation knob for rotating the valve member. The valve member has a rotation center between the two inlet openings of the first air passage and the second air passage.

Using just one choke valve in this manner makes it possible to avoid the operating system from becoming complex and the entire device from becoming large.

In such a stratified scavenging two-stroke engine, in addition to avoiding the operating system from becoming complex and the entire device from becoming large by using one choke valve as described above, high airtightness is required when the choke valve closes the openings.

The technique disclosed in Japanese Patent No. 4052416 uses a rotary valve member as the choke valve, so that the inlets of two passages are simultaneously opened and closed with one choke valve, whereby the operating system of the choke valve is prevented from becoming complex and the device from becoming large, as well as high airtightness is achieved when the choke valve closes the openings.

However, with the technique disclosed in Japanese Patent No. 4052416, while high airtightness is achieved when the choke valve closes the openings as noted above, there is a problem that processing of the sealing surface for achieving the airtightness is difficult, since the sealing surface is large because of the use of the rotary valve member that has the rotation center positioned between the inlet openings of the two passages.

Accordingly, a choke valve capable on its own, without using a rotary valve member, of opening and closing the inlets of two passages simultaneously and of ensuring high airtightness, is desirable.

A possible solution would be to employ a pivotable choke valve that can open and close the inlets of two passages simultaneously. However, if employed, a simply pivoting choke valve would need a large valve member and a large operating angle range in order to open and close the two passages simultaneously. This will increase the size of the choke valve itself and its work range, which will in turn increase the size of the entire device.

SUMMARY OF THE INVENTION

Accordingly, in view of such a problem in the conventional technique, an object of the present invention is to provide an air cleaner in two-stroke engines, which employs a pivotable choke valve so as to readily achieve high airtightness when closing inlets, the choke valve being capable on its own of simultaneously opening and closing both inlets of an air passage and an air/fuel mixture passage, and operable in a small angle range and in a small work range.

To solve the problem mentioned above, the present invention provides an air cleaner in a two-stroke engine having an air supply passage that is connected midway of a scavenging passage communicating a scavenging port provided in a side portion of a cylinder with a crank chamber and that supplies leading air from the air cleaner to the scavenging passage, and an air/fuel mixture supply passage supplying air/fuel mixture created in a carburetor to the crank chamber, the air cleaner including:

a first air passage and a second air passage arranged in parallel, the first air passage being communicated with the air supply passage and the second air passage being communicated with the air/fuel mixture supply passage; and a choke valve opening and closing both of the first air passage and the second air passage of the air cleaner, wherein the choke valve has a pivot axis and a pivotable valve member pivoting about the pivot axis to open and close respective inlet openings of the first air passage and the second air passage, and one of the first air passage and the second air passage that is located closer to the pivot axis has an inlet opening flattened along a pivoting edge of the valve member.

As one of the air passages that is located closer to the pivot axis of the choke valve (first air passage or second air passage) has a shape flattened along a pivoting edge of the valve member, the operating angle of the choke valve when opening and closing the openings is made smaller, and the work range of the valve member is reduced, so that the entire air cleaner is prevented from becoming large.

One of the first air passage and the second air passage that is located closer to the pivot axis may have an outlet shaped corresponding to an inlet shape of the air supply passage or the air/fuel mixture supply passage connected thereto.

Thereby, air from the air passage closer to the pivot axis is supplied smoothly into the air supply passage or the air/fuel mixture supply passage connected to this air passage.

The air passage closer to the pivot axis may be the first air passage.

When the engine is started, air should preferably be supplied to the air/fuel mixture supply passage first before it is supplied to the air supply passage. Thus, if the first air passage is the air passage closer to the pivot axis, the second air passage connected to the air/fuel mixture supply passage will be opened first before the first air passage connected to the air supply passage when the choke valve starts to open.

The present invention can provide an air cleaner in two-stroke engines, which employs a pivotable choke valve so as to readily achieve high airtightness when closing inlets, the choke valve being capable on its own of simultaneously opening and closing both inlets of an air passage and an air/fuel mixture passage, and operable in a small angle range and in a small work range.

DETAILED DESCRIPTION OF THE INVENTION

Preferred embodiments of the present invention will be hereinafter illustratively described in detail with reference to the drawings. It should be understood that the sizes, materials, and shapes of the constituent elements described in the embodiments, and their positions relative to each other, are given for illustrative purposes only and not meant to limit the scope of this invention, unless specifically stated otherwise.

Figure 1:
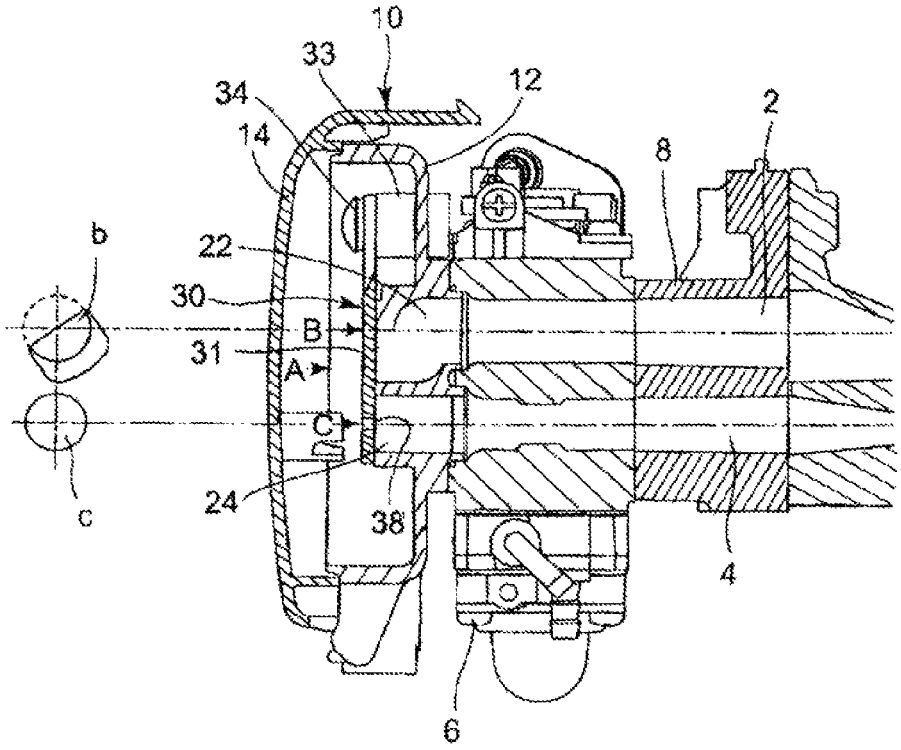
FIG. 1 is a structural view illustrating the structure of the vicinity of an air cleaner device for two-stroke engines according to one embodiment of the present invention.

FIG. 1 is a structural view illustrating the structure of the vicinity of an air cleaner device for two-stroke engines according to one embodiment of the present invention.

In FIG. 1, reference numeral 6 denotes a carburetor, and 8 denotes an insulator interposed between the carburetor 6 and a cylinder (not shown).

Reference numeral 2 denotes an air supply passage, configured to communicate an air passage in the carburetor 6 via inside the insulator 8 with a scavenging port (not shown) opened in a side portion of the cylinder and a scavenging passage connected to the scavenging port. Reference numeral 4 denotes an air/fuel mixture supply passage, configured to communicate a throttle passage in the carburetor 6 via inside the insulator 8 and through inside the cylinder with a crank chamber.

Reference numeral 10 denotes an air cleaner, which is formed as described below.

Reference numeral 12 denotes a cleaner case, which is secured to the carburetor 6 with fastening means (not shown) such as bolts. Reference numeral 14 denotes a cleaner cover, which is secured to the cleaner case 12 with a plurality of fastening means (not shown) such as bolts.

Inside the cleaner case 12 are formed two air passages in parallel, a first air passage 22 and a second air passage 24. The first air passage 22 is connected to the air supply passage 2, while the second air passage 24 is connected to the air/fuel mixture supply passage 4. Reference symbols b and c shown in FIG. 1 represent the first air passage 22 and second air passage 24, respectively, viewed from the directions of arrows B and C shown in FIG. 1.

Reference numeral 30 denotes a choke valve switchably opening and closing the first air passage 22 connected to the air supply passage 2 and the second air passage 24 connected to the air/fuel mixture supply passage 4.

Figure 2:
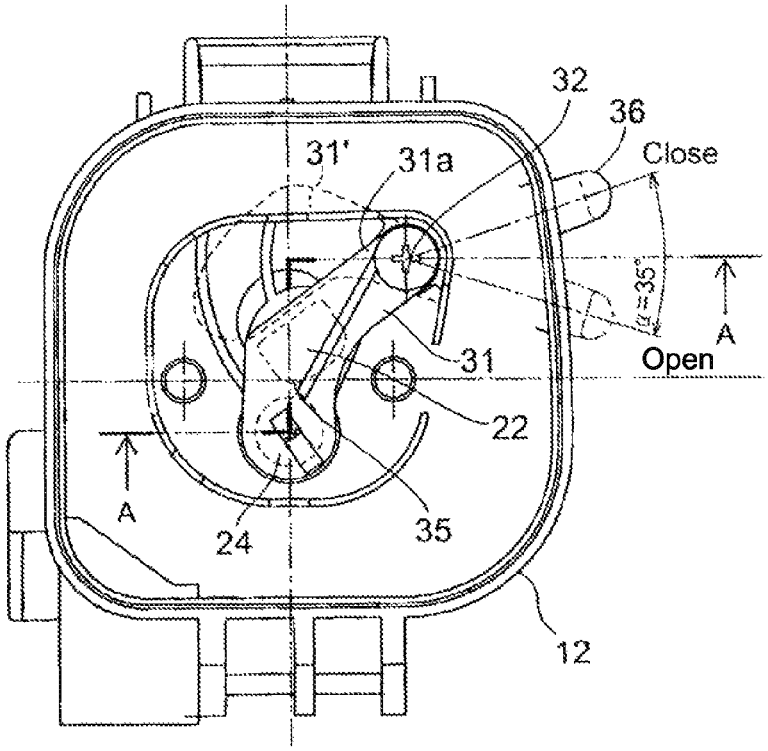
FIG. 2 is a diagram as viewed in the direction of arrows A in FIG. 1.
Figure 3:
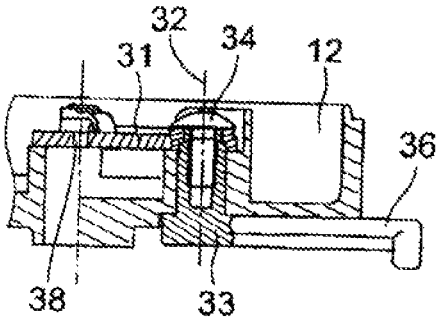
FIG. 3 is a cross section along A-A of FIG. 2.

FIG. 2 is a diagram as viewed in the direction of arrows A in FIG. 1, and FIG. 3 is a cross section along A-A of FIG. 2.

In FIG. 1 to FIG. 3, reference numeral 31 denotes a valve member having a dog-legged (boomerang) shape as viewed in plan view. Being in a dog-legged shape in plan view, the valve member 31 can have a shorter overall length and a smaller operating angle $\alpha$ to be described later.

The valve member 31 is attached to a screw 34 such as to be pivotable about a pivot center 32 offset from a central part 35 of the cleaner case 12 and configured to pivot by a lever 36 being operated. The screw 34 is fixedly threaded in a fastening member 33 secured to the cleaner case 12.

With this configuration, the choke valve 30 opens and closes the inlet openings of the first air passage 22 and second air passage 24 with the valve member 31 pivoting at an operating angle $\alpha$ of 35° about the pivot center 32. The sheet surface 36 of the valve member 31 at this time moves in a sliding manner on the surface of the cleaner case 12 where the inlet openings of the two air passages 22 and 24 exist.

In FIG. 2, the valve member 31 of the choke valve 30 when it closes the openings is indicated by a solid line, while the valve member of the choke valve 30 when it opens the openings is indicated by a dotted line and denoted at reference numeral 31'. While the valve member 31 pivots only at an operating angle $\alpha$ of 35° about the pivot center 32 to open and close in a switching manner in this embodiment, the operating angle (35°) is not limited to 35° as it is determined discretely for each device depending on the positions of the first and second air passages 22 and 24, and the position of the pivot center 32.

The characteristic feature of the present invention is that, as shown in FIG. 2, one of the two air passages (first and second air passages 22 and 24) that is located closer to the pivot center 32 of the choke valve 30 (first air passage 22) is flattened along a pivoting edge 31*a* of the valve member 31. Here, the pivoting edge 31*a* refers to an edge of the valve member 31 when it is closing the openings.

Further, as shown in FIG. 1, the first air passage 22 has its cross-sectional shape changing midway so that it is connected to the air supply passage 2 at the outlet side in substantially the same shape as that of the air supply passage 2. Therefore, air from the first air passage 22 is smoothly supplied to the air supply passage 2.

In the air cleaner device for two-stroke engines configured as described above, when the engine is started, the choke valve 30 is operated so that the valve member 31 is pivoted about the pivot center 32, to entirely close the second air passage 24 connected to the air/fuel mixture supply passage 4 (except for a small choke hole 38 that remains open), as well as the first air passage 22 connected to the air supply passage 2 for supplying leading air, for the engine to be started.

With this operation of the choke valve 30, air filtered in the air cleaner 10 enters the second air passage 24 through the choke hole 38, and, from the second air passage 24, is supplied to a main nozzle side of the carburetor 6 connected thereto. Fuel is atomized in air to create air/fuel mixture inside the carburetor 12, this air/fuel mixture being supplied from the air/fuel mixture supply passage 4 through the crank chamber, scavenging passage, and scavenging port into the combustion chamber of the engine to be ignited and burnt, whereby the engine is started.

In such starting of the engine, since the first air passage 22 is entirely closed by the valve member 31 of the choke valve 30, supply of leading air into the combustion chamber from the first air passage 22 and the air supply passage 2 is shut off, so that the air/fuel mixture alone is supplied that is generated in the carburetor 6 using the air that has passed through the second air passage 4 after the air flow has been narrowed down at the choke hole 38. Thereby the combustion chamber 25 can be filled with air/fuel mixture with a richer fuel ratio to improve the startability of the engine.

The sheet surface 36 of the valve member 31 of the choke valve 30 can close the inlets of the two air passages 22 and 24 with high airtightness so that the condition for creating the rich air/fuel mixture mentioned above, as well as a high negative pressure, can be maintained.

Moreover, one of the two air passages (first air passage 22 and second air passage 24) that is located closer to the pivot center 32 of the choke valve 30 (first air passage 22) has a shape flattened along the rotating edge 31*a* of the valve member 31, so that the choke valve 30 can open and close the openings with a smaller operating angle α, and thus the work range of the valve member 31 is made smaller, which in turn prevents an increase in size of the entire air cleaner.

Figure 4A:
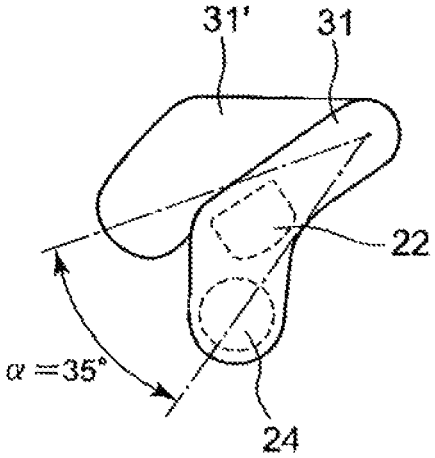
FIGS. 4(*a*) and 4(*b*) are diagrams explaining the effects of the first air passage 22 having a shape flattened along the rotating edge 31*a* of the valve member 31, FIG. 4(*a*) being a diagram explaining the operating angle of the choke valve in an embodiment, and FIG. 4(*b*) being a diagram explaining the operating angle of the choke valve in a reference example in which the inlet opening of the first air passage 22 is not formed flat.
Figure 4B:
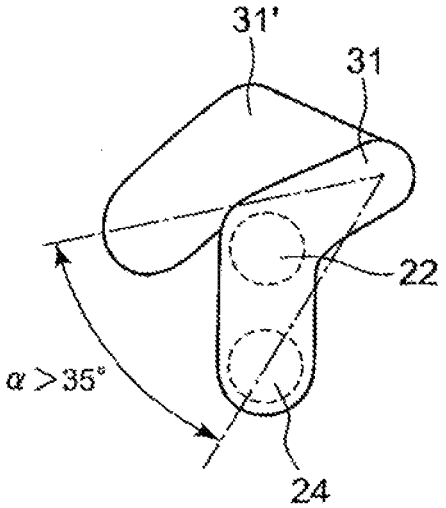

FIG. 4 is a diagram explaining the effects of the first air passage 22 having a shape flatted along the rotating edge 31*a* of the valve member 31.

FIG. 4(*a*) is a diagram explaining the operating angle of the choke valve in one embodiment, and FIG. 4(*b*) is a diagram explaining the operating angle of the choke valve in a reference example in which the inlet opening of the first air passage 22 is not formed flat. The reference example shown in FIG. 4(*b*) is identical to this embodiment except that the inlet opening of the first air passage 22 is not flattened.

As shown in FIG. 4(*a*), while the operating angle α is 35° in this embodiment, the operating angle α has to be larger than 35° in the reference example shown in FIG. 4(*b*) in order to completely open the first air passage. Namely, it can be said that forming the inlet opening of the first air passage 22 in a flat shape along the rotating edge 31*a* of the valve member 31 makes the operating angle α of the choke valve smaller.

The present invention is applicable as an air cleaner in two-stroke engines, which employs a pivotable choke valve so as to readily achieve high airtightness when closing inlets, the choke valve being capable on its own of simultaneously opening and closing both inlets of an air passage and an air/fuel mixture passage, and operable in a small angle range and in a small work range.

The invention claimed is:

1. An air cleaner in a two-stroke engine having an air supply passage that is connected midway of a scavenging passage communicating a scavenging port provided in a side portion of a cylinder with a crank chamber and that supplies leading air from the air cleaner to the scavenging passage, and an air/fuel mixture supply passage supplying air/fuel mixture created in a carburetor to the crank chamber, the air cleaner comprising:

a first air passage and a second air passage arranged in parallel, the first air passage being communicated with the air supply passage and the second air passage being communicated with the air/fuel mixture supply passage; and a choke valve opening and closing both of the first air passage and the second air passage of the air cleaner, wherein the choke valve has a pivot axis and a pivotable valve member that is pivotable about the pivot axis so as to slide the choke valve on a surface having two inlet openings comprising the inlet opening of the first air passage and the inlet opening of the second air passage, and to open and close the inlet opening of the first air passage and the inlet opening of the second air passage, respectively, and one of the first air passage or the second air passage that is located closer to the pivot axis has an inlet opening flattened along a pivoting edge of the valve member.

2. The air cleaner in a two-stroke engine according to claim 1, wherein one of the first air passage or the second air passage that is located closer to the pivot has an outlet shaped so as to correspond to an inlet shape of the air supply passage or the air/fuel mixture supply passage connected to said one of the first air passage or the second air passage.

3. The air cleaner in a two-stroke engine according to claim 1, wherein the first air passage is closer to the pivot axis.

4. The air cleaner in a two-stroke engine according to claim 2, wherein the first air passage is closer to the pivot axis.

* * * * *